US005632429A

United States Patent [19]

Cantwell

[11] Patent Number: 5,632,429

[45] Date of Patent: May 27, 1997

[54] BACKPACK

[75] Inventor: Robert R. Cantwell, Leslie, Mo.

[73] Assignee: American Recreation Products, Inc., St. Louis, Mo.

[21] Appl. No.: 396,910

[22] Filed: Feb. 28, 1995

[51] Int. Cl.[6] ..... A45F 3/04

[52] U.S. Cl. ..... 224/630; 224/643; 224/644; 224/264

[58] Field of Search ..... 224/264, 209, 224/630, 643, 644, 657

[56] References Cited

U.S. PATENT DOCUMENTS

| | | | |
|---|---|---|---|
| 4,420,103 | 12/1983 | Douglass | 224/209 X |
| 4,942,995 | 7/1990 | Myers | 224/264 X |
| 4,984,662 | 1/1991 | Jacober | 224/209 X |
| 5,250,345 | 10/1993 | Chu | 224/264 X |
| 5,267,680 | 12/1993 | Torok | 224/264 X |
| 5,318,084 | 6/1994 | Jackson | 224/264 X |
| 5,370,287 | 12/1994 | Cormier | 224/209 |

FOREIGN PATENT DOCUMENTS

| | | | |
|---|---|---|---|
| 410573 | 2/1947 | Germany | 224/264 |

*Primary Examiner*—Renee S. Luebke
*Attorney, Agent, or Firm*—Senniger, Powers, Leavitt & Roedel

[57] ABSTRACT

A backpack having a resilient member associated with one of the panels of material forming the backpack. The resilient member is held in an elastically deformed configuration on the one panel so that it stiffens that panel and tends to hold the backpack open. Shoulder straps of the backpack are constructed with ventilation channels on their undersides of the straps and portion of the body underlying the straps. The underside of each strap includes frictionalizing material for engagement with the top of the shoulder of the person wearing the backpack. Each strap also includes a load distributing region generally located along the length of the strap for engagement with the top of the shoulder of the person wearing the backpack. At least one strap includes a pocket having an opening extending generally longitudinally and transversely across the strap.

24 Claims, 7 Drawing Sheets

40
32L
88
28
88
P
T
32R
36R
44
62
22
66
70
68
74
82
74
24
80
74
54
52
74
38R
26
39
58
34R
46
50
30

BACKPACK

BACKGROUND OF THE INVENTION

A conventional backpack is constructed of panels of lightweight, flexible material which are joined together to define a volume for receiving and holding articles to be carried on the back. Two or more of the panels may be releasably connected such as by a zipper. The panels may be separated when the zipper is open to define an opening into the interior of the backpack for removing or inserting articles. Heretofore, it has been difficult to maintain the opening for the purpose of inserting or removing articles. The flexible nature of the material making up the panels tends to cause one or both panels to collapse into the opening and close it. The difficulty is most acute when trying to insert articles into the backpack. The articles tend to engage the panel and push it into the opening.

Once the backpack is loaded, the comfort of the wearer is paramount. The load of the backpack is supported on the tops of the shoulders of the wearer. As a result straps of the backpack are generally held tightly against the top and adjacent regions of the shoulder. Many backpack materials used for the straps do not permit the wearers skin located under the straps to breathe so that the shoulder can become uncomfortably hot and induce substantial perspiration. The material forming the backpack can be sufficiently slick as to cause the strap to slip relative to the shoulder, undesirably shifting the load of the backpack. Another consequence of the load is that the tops of the shoulders experience the greatest force pressing down against them. The pressure exerted by the straps on the tops of the shoulders can itself cause discomfort, particularly on long hikes.

SUMMARY OF THE INVENTION

Among the several objects and features of the present invention may be noted the provision of an article such as a backpack which facilitates the insertion and removal of articles from the backpack; the provision of such a backpack which is of sturdy construction; the provision of such a backpack which holds its configuration; the provision of such a backpack which permits the tops of the wearer's shoulders to breathe under the backpack straps; the provision of such a backpack which may be held without slipping on the wearer's shoulders; the provision of such a backpack which reduces the pressure on the wearer's shoulders; and the provision of such a backpack which makes an economical use of materials.

Generally, an article comprising panels connected together and arranged for enclosing a volume. At least some of the panels are made of a generally limp material. The article has an opening which is at least partially bounded by the generally limp panel material. Means for stiffening the generally limp panel material at least partially bounding the opening biases a region of the generally limp panel material at least partially bounding the opening to hold open the opening. The stiffening means comprises a resilient member connected to the bounding region of the generally limp panel material. Means associated with the generally limp panel material holds the resilient member in a configuration displaced from a relaxed configuration of the resilient member.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
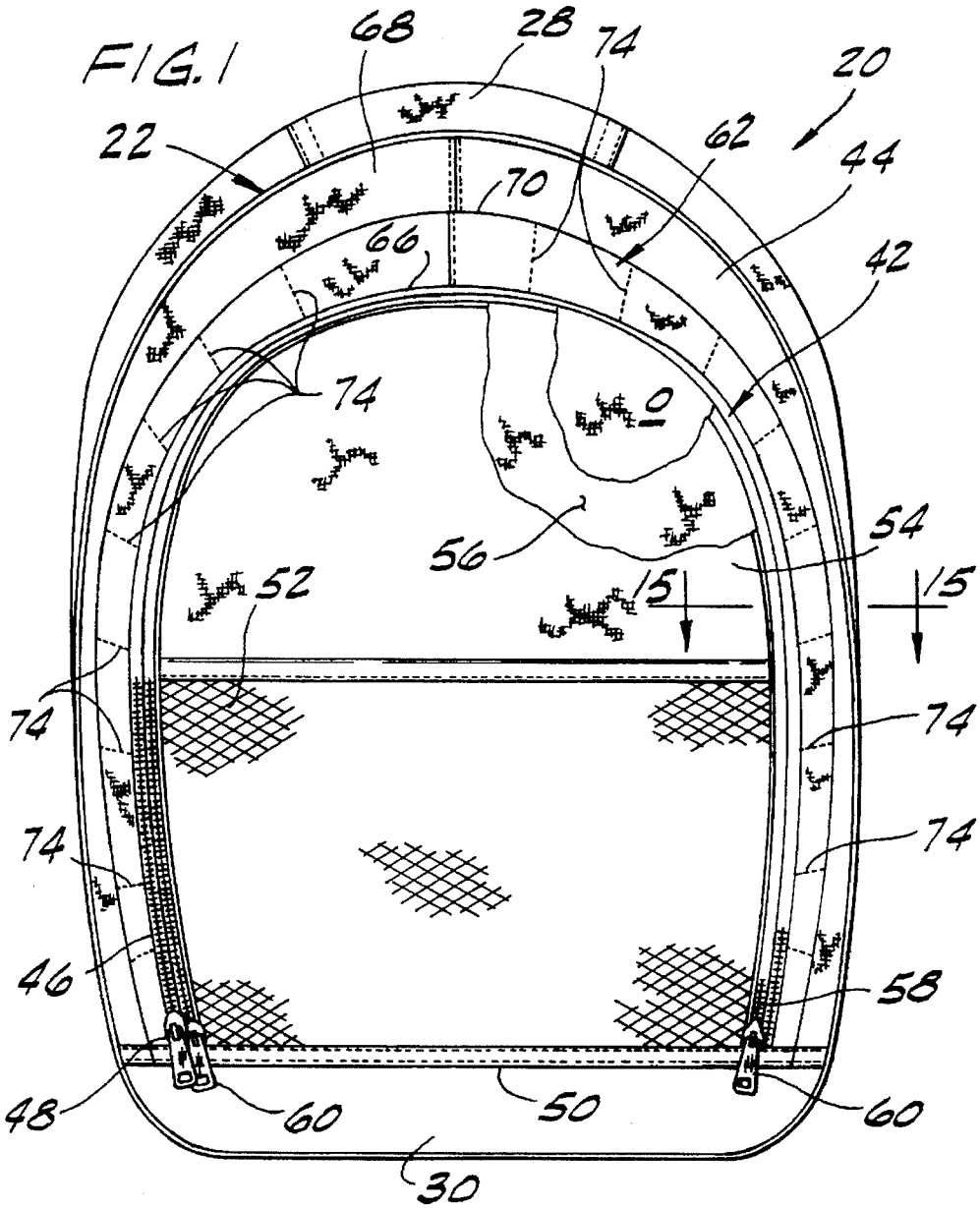
FIG. 1 is a front elevation of a backpack.
Figure 2:
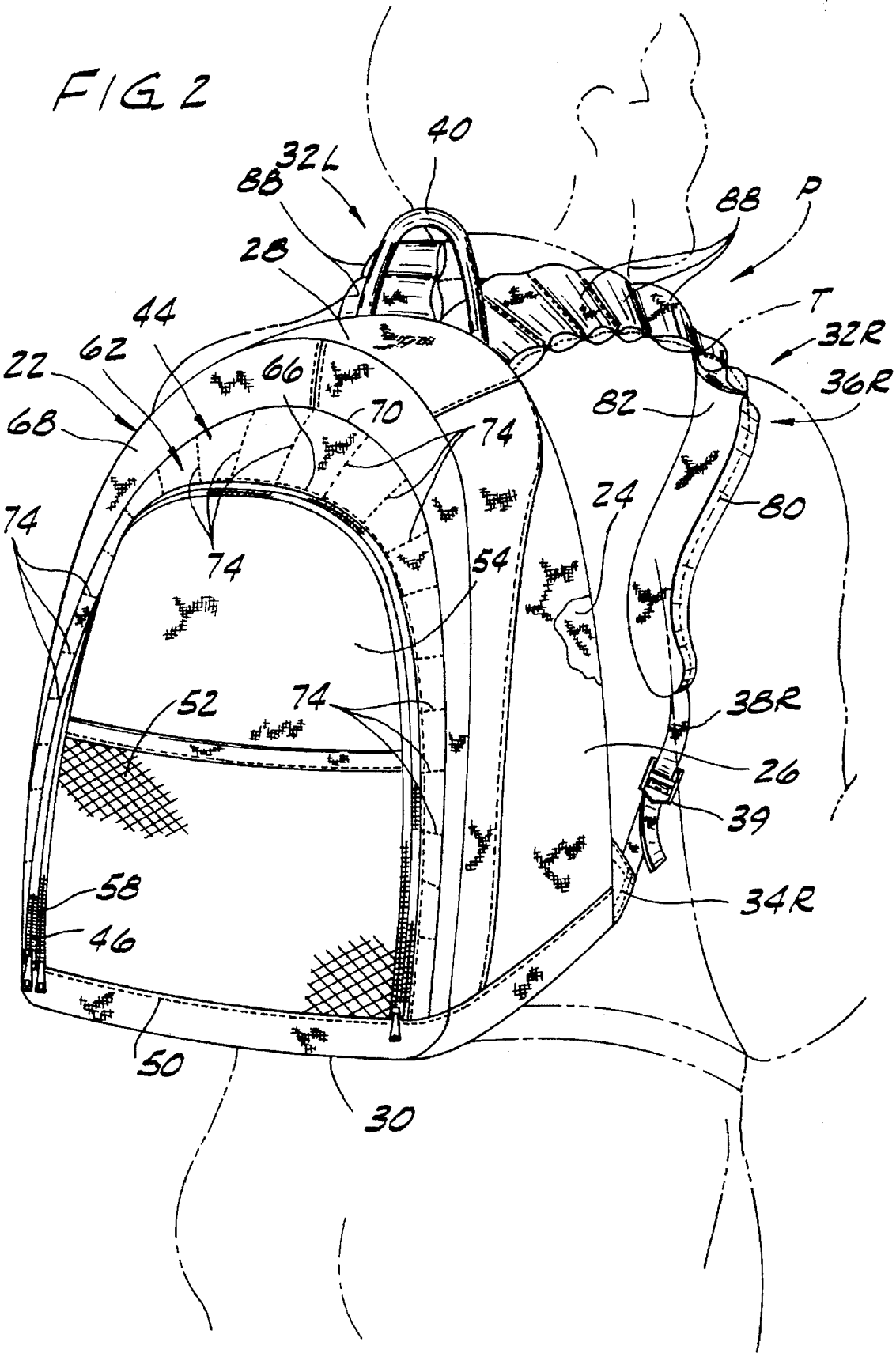
FIG. 2 is a front and right side perspective view of a backpack as worn by a person.
Figure 3:
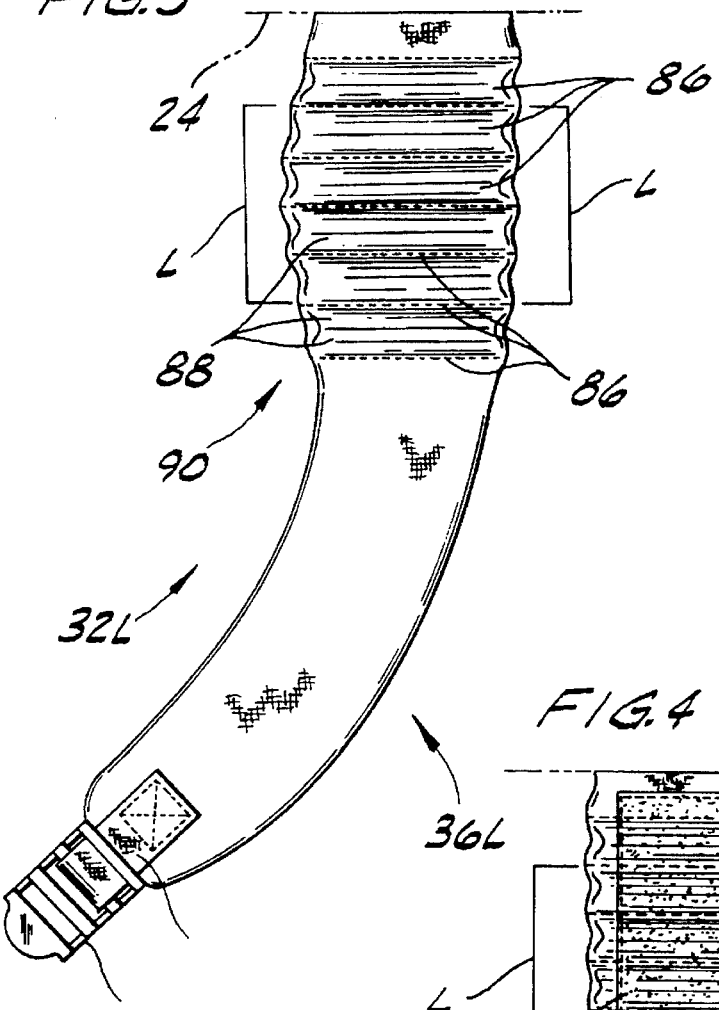
FIG. 3 is a fragmentary, front plan view of a left shoulder strap of the backpack.

Referring now to the drawings, and in particular to FIGS. 1 and 2, a backpack (broadly, "an article") indicated generally at 20 is shown to comprise panels including a front panel (generally indicated at 22), a rear panel 24, side panels 26, a top panel 28 and a bottom panel 30 made of a suitable lightweight, flexible material such as a nylon material or leather. The panels are capable of defining a volume for holding articles (not shown), such as camping equipment, to be carried by a person P. It is to be understood that the panels 22–30 may be, but are not necessarily made of a single, unitary sheet of material, and are preferably formed from multiple sheets of material joined together as by stitching. A pair of shoulder straps, generally indicated at 32L and 32R, respectively, are joined at upper ends to the rear panel 24 generally adjacent to the top panel 28, and at lower ends at spaced apart locations by respective flaps 34R (only one is shown, the other being a mirror image thereof) to the rear panel and bottom panel 30. As best seen in FIGS. 2, 3, 9 and 10, the straps 32L, 32R have upper padded portions, generally indicated at 36L, 36R, respectively, adapted to extend over the tops of the shoulders of the person P wearing the backpack 20, and a lower, two-piece strap member 38L, 38R, including a buckle 39 for use in adjusting the length of the lower strap member. As shown in FIG. 2, a handle 40 is provided for carrying the backpack 20 when not worn on the back.

Figure 15:
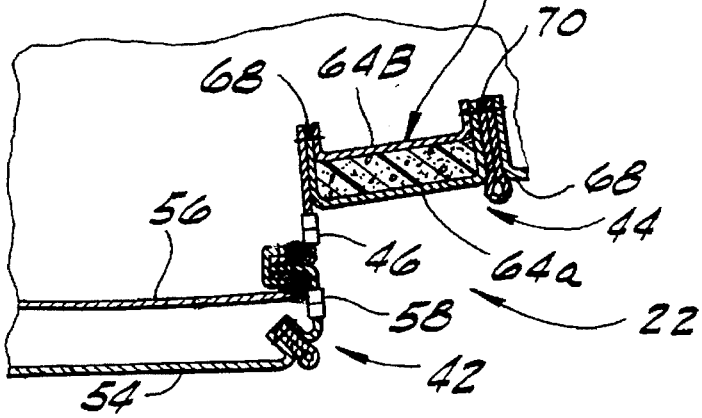
FIG. 15 is a section taken in the plane of line 15—15 of FIG. 1.

The front panel 22 includes an inner section and an outer section (generally indicated at 42 and 44, respectively), to which the inner section is releasably connected by a first zipper closure 46 extending in an inverted-U path around the inner section and having a slide 48. The inner and outer sections 42, 44 are both joined to the bottom panel 30 along seam 50. An elastic netting 52 joined to the inner section 42 along its side and bottom edge margins defines an exterior pocket of the backpack 20 for carrying other articles. Referring now particularly to FIGS. 1 and 15, the inner section 42 includes an outer member 54 and an inner member 56, both connected in the seam 50 to the bottom panel 30. The inner and outer members 54, 56 are releasably connected to each other by a second zipper closure 58 extending in an inverted-U path generally parallel to the first zipper closure 46. The second zipper closure 58 has slides 60 at each end of the closure.

When the first zipper closure 46 is unzipped, the inner section 42 can be moved away from the outer section 44 by folding on the lower edge of the inner section (i.e., at the seam 50) to expose an opening O into the interior of the backpack 20 (FIG. 1). Articles (not shown) may be inserted through the opening O and into the interior of the backpack 20, and the opening closed by moving the inner section 42 to again cover the opening and zipping up the first zipper closure 46. The outer member 54 of the inner section 42 can be moved away from the inner member 56 after unzipping the second zipper closure 58. Additional, relatively flat articles (also not shown) may be placed into the space between the inner and outer members 54, 56 and secured therein by closing the second zipper closure 58.

Figure 13:
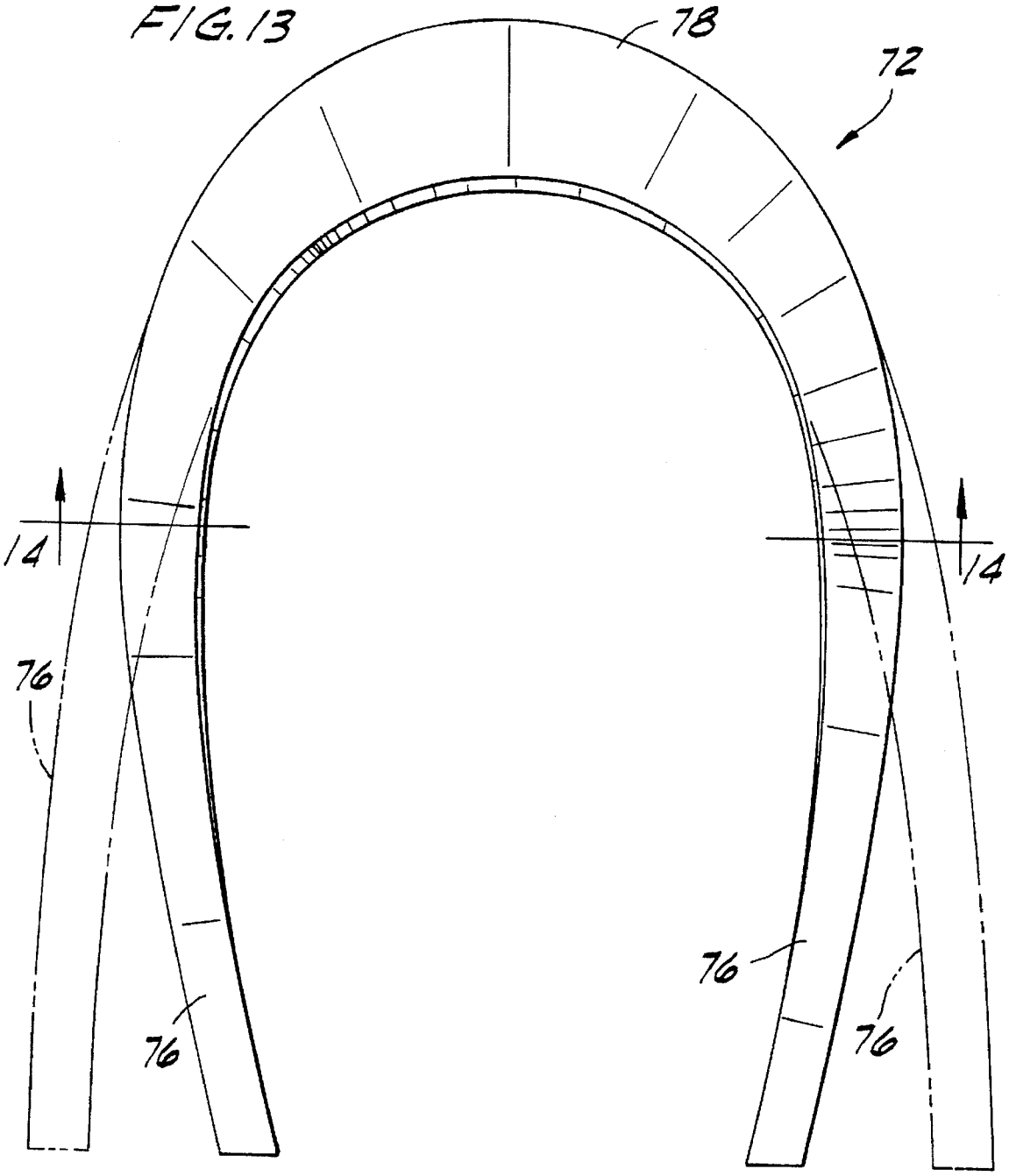
FIG. 13 is a front plan view of the stiffening member displaced from a relaxed configuration indicated in phantom.

Referring to FIG. 15, the outer section 44 of the front panel 22 includes a pocket, indicated generally at 62, which is located immediately adjacent to the inner section 42 and has an inverted-U shape corresponding to the shape of the outer edge of the inner section (see FIG. 1). The pocket 62 is formed by two pieces of material 64A, 64B, each having an inverted-U shape in plan. The pieces of material 64A, 64B are joined to each other and to the first zipper closure 46 of the inner section 42 along a seam 66, and are joined to each other and to an outer portion 68 of the outer section 44 along a seam 70. The pocket 62 contains a resilient member (indicated in its entirety by reference numeral 72) having a generally horseshoe shape and made out of a lightweight, resilient material such as foam rubber (FIG. 13). It is to be understood that the shape of the resilient member 72 may be other than that of a horseshoe and still fall within the scope of the present invention. Spaced apart, transverse lines of stitching 74 join the resilient member 72 to the pocket 62. The lines of stitching 74 help to hold the resilient member 72 in place within the pocket 62 and provide an ornamental, shell-like appearance to the exterior of the pocket. The pocket 62 and the stitching lines 74 form the "holding means" in the preferred embodiment. However, it is envisioned that the holding means may take several forms, including specifically either the pocket 62 or the lines of stitching 74 independently of the other, and fall within the scope of the present invention. Moreover, it is envisioned that the holding means has application for holding open openings and stiffening walls in other container type articles made of lightweight, flexible material, without substantially increasing the weight of the article.

Figure 14:
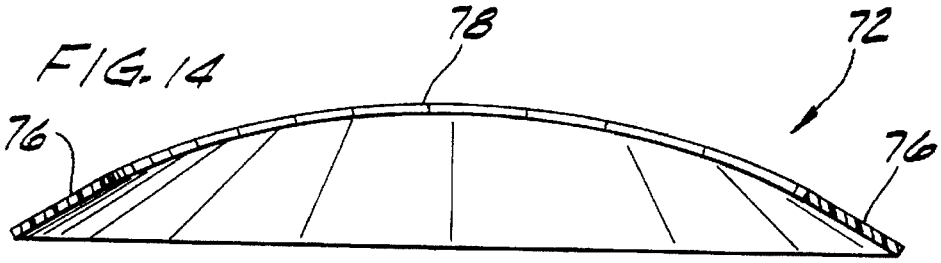
FIG. 14 is a section taken in the plane of line 14—14 of FIG. 13.

The resilient member 72 is shown, outside of the pocket 62 and separated from the backpack 20 in FIG. 13. The location of the outer peripheral edge of the resilient member 72 in its relaxed configuration is shown in phantom in FIG. 13. In the relaxed configuration, the resilient member assumes a generally planar configuration, but tends to be flexible, that is, it does not tend to hold its shape by providing resistance to bending out of its configuration. However, as held in the pocket 62 and by the stitching 74, arms 76 of the resilient member 72 are displaced inwardly from their relaxed configuration as shown in solid lines in FIG. 13. The displacement of the arms 76 causes a head portion 78 of the resilient member 72 to tend to bow out of the plane of the resilient member in the relaxed configuration, as shown in FIG. 14. However, the pocket 62 and stitching lines 74 substantially restrain the head portion 78 from bowing out of its plane. As a result of the displacement of the arms 76 and restraint of the head portion 78, the resilient member 72 is placed under stress and tends to hold its shape and urge the inner section 42 (when connected to the outer section) and at least a portion of the outer section 44 to retain a generally flat configuration.

The location of the resilient member 72 generally around the opening formed by moving away the inner section 42 from the outer section 44 greatly facilitates holding the opening open to its full dimension. Thus, although the material from which the backpack 20 is made is flexible and tends to bend or fold under its own weight, it is held from collapsing into the opening by the resilient member 72. More specifically, the resilient member 72 in its displaced configuration urges the outer section 44 away from the opening O and tends to hold the outer section in an upright and opened position. In this way, insertion and removal of articles from the backpack 20 is made easier and more convenient.

Figure 4:
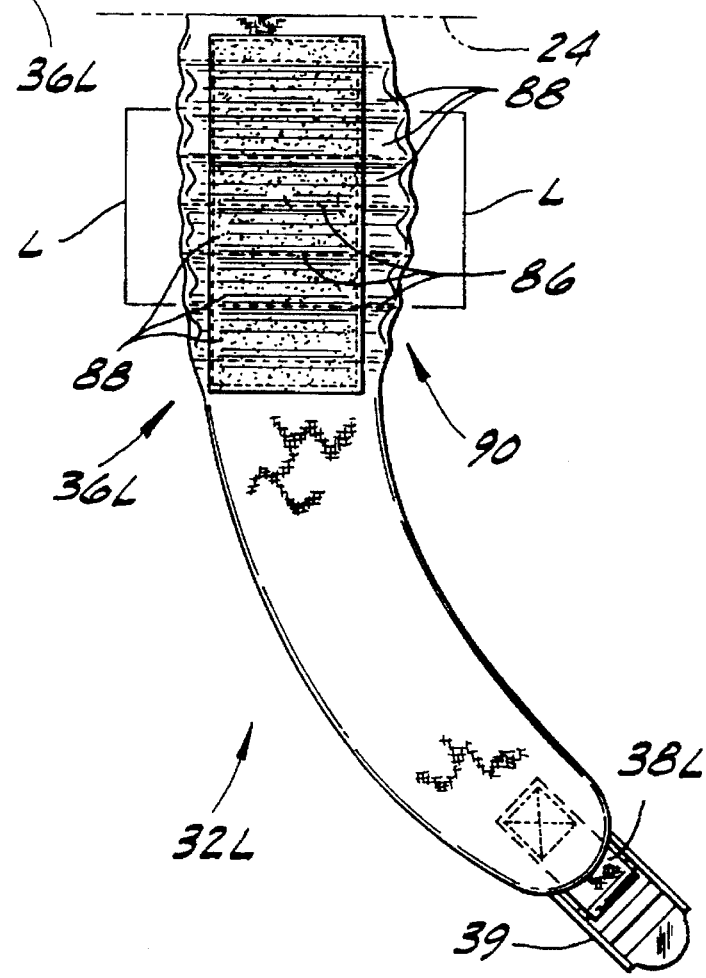
FIG. 4 is a fragmentary, rear plan view of the shoulder strap of FIG. 3.
Figure 5:
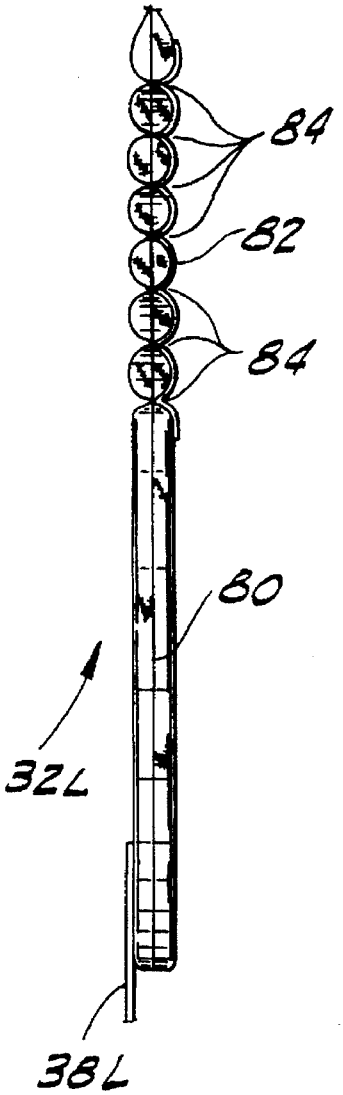
FIG. 5 is a right side elevational view thereof.
Figure 6:
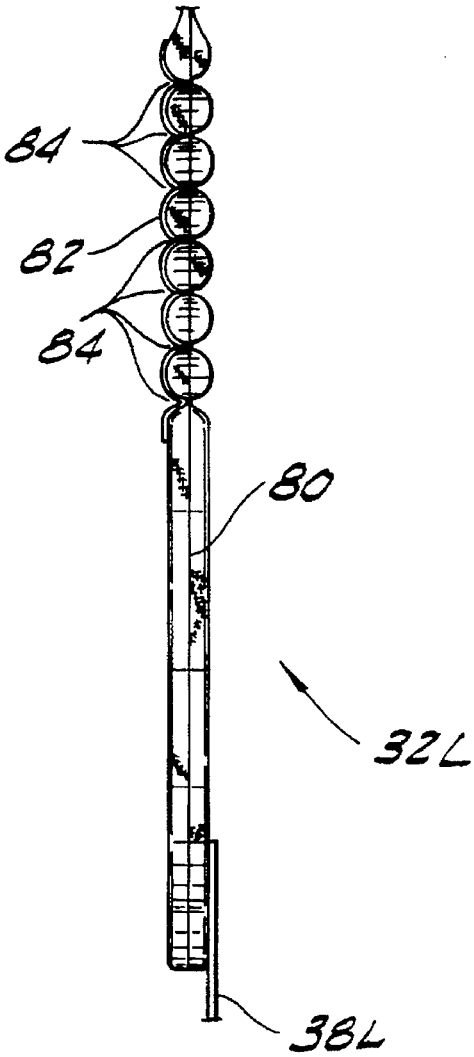
FIG. 6 is a left side elevational view thereof.
Figure 7:
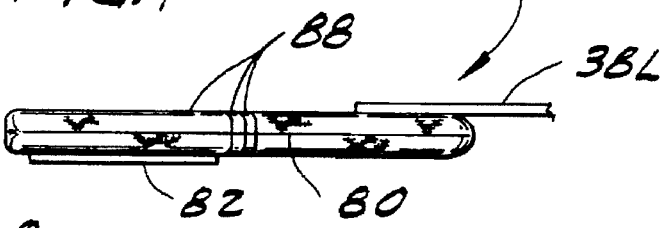
FIG. 7 is a top plan view of an upper padded portion of the shoulder strap of FIG. 3.
Figure 8:
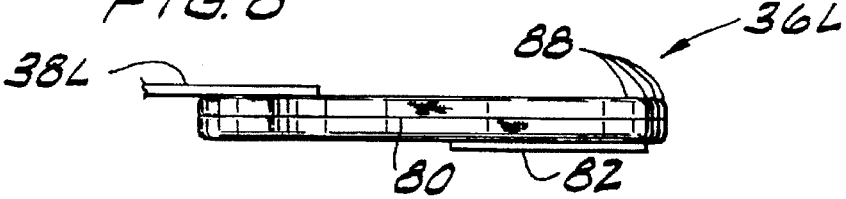
FIG. 8 is a bottom plan view of the upper padded portion.
Figure 9:
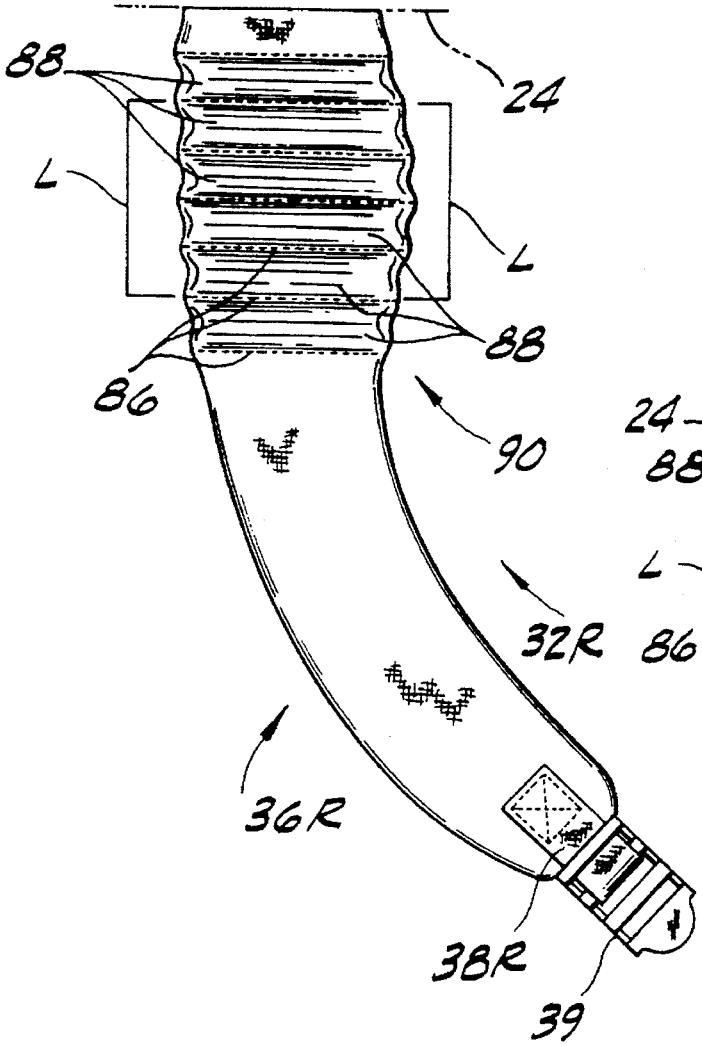
FIG. 9 is a fragmentary, front plan view of a right shoulder strap of the backpack.
Figure 10:
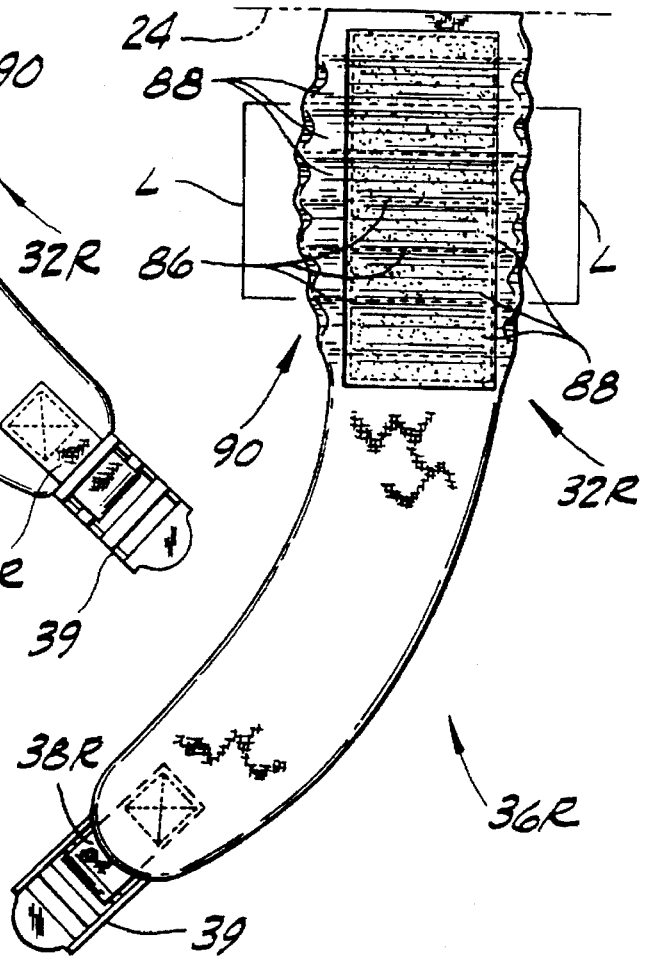
FIG. 10 is a fragmentary, rear plan view of the shoulder strap of FIG. 9.

As shown in FIG. 2, the loaded backpack 20 is constructed to be worn on the back of the person P (in the conventional fashion), with the upper portions 36L, 36R of the shoulder straps 32L, 32R extending over the tops T of the shoulders. The upper padded portions 36L, 36R of the shoulder straps 32L, 32R are each made by encasing padding (not shown) between sheets of material joined at adjacent edge margins by stitching 80 (FIGS. 5 and 6). The upper portions 36L, 36R are engaged with the upper back, shoulder and upper chest of the person P for comfortably supporting the weight of the backpack 20. As may be seen in FIGS. 4 and 10, the underside of the upper portions 36L, 36R of the straps 32L, 32R are covered with a frictionalizing material 82, such as sueded leather or other suitable non-slip material, which grips the clothing of the person P wearing the backpack to prevent each shoulder strap from sliding.

Referring now to FIGS. 5 and 6, ventilation channels 84 on the undersides of the shoulder straps 32L, 32R permit air under the straps for cooling and evaporation of moisture from the body of the person P wearing the backpack 20. In the preferred embodiment, the ventilation channels 84 are formed by transverse lines of stitching 86 (see FIGS. 3, 4, 9 and 10) in the shoulder straps 32L, 32R which pull together the front side of each strap with the underside and defines a plurality of side-by-side roll members 88 forming collectively a roll portion of the shoulder strap. As one alternative (not shown) to stitching 86, it is envisioned that the material (e.g., nylon material) could be molded to achieve the rolled shape. The ventilation channels 84 are defined between adjacent roll members 88 on the underside of the shoulder straps 32L, 32R. The rolled appearance of the straps 32L, 32R of the front sides is not necessary to the ventilation function of the straps, but has a unique ornamental appearance.

It is envisioned that ventilation channels (not shown) could be formed in other ways which do not affect the appearance of the front side of the shoulder straps and still fall within the scope of this invention. For instance, the padding could be formed with a flat outer surface and ventilation channels on the underside. The material of the shoulder straps on the underside of the shoulder straps could be made to conform to the shape of the padding. The material on the front sides of the straps could be selected to be more rigid than that on the undersides so that when the underside material was stitched to the front material, the front material was not pinched inwardly along the line of stitching. Of course, the possible constructions of ventilation channels particularly described herein are not exclusive of other constructions which fall within the scope of the present invention.

Referring again to FIGS. 3, 4, 9 and 10, the upper portions 36L, 36R of the shoulder straps 32L, 32R also include a primary load distributing region (defined between brackets L in the drawings) which is positioned along the length of each strap for engaging the top T of the shoulder and adjacent portions of the body of the person P wearing the backpack 20. The load distributing region L has a greater surface area engageable with the shoulder of the person P wearing the backpack 20 than the surrounding regions of the strap 32L or 32R, and thus distributes the load over a wider portion of the shoulder at the location where most of the weight of the backpack is supported. In the preferred embodiment, the load distributing region L includes a projection (designated generally by reference numeral 90) extending laterally inwardly from a laterally inner edge margin of each shoulder strap. Thus, the shoulder straps 32L, 32R of the present invention employ more material to spread the distribution of the load precisely where the load is the greatest. Elsewhere, the width of the strap is less, requiring a lesser amount of material and having a trim appearance. It is envisioned that the load distributing regions L could have other configurations than shown in the preferred embodiment and fall within the scope of the present invention. For instance, the projection could be on the laterally outer edge of the straps, or on both sides (not shown). It would also be possible for a projection (not shown) to have a rectangular, triangular or other shape while performing the function of distributing the load widely over the top of the shoulder. The precise configuration of the load distributing region may be selected according to the desired ornamental appearance of the shoulder strap.

Figure 11:
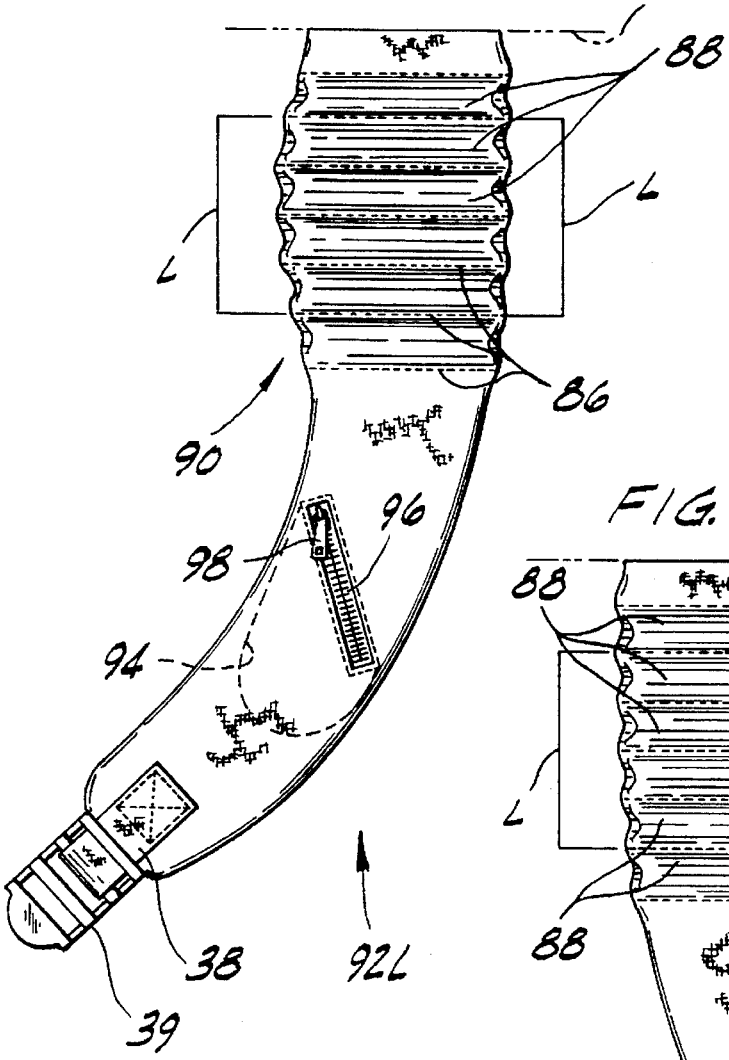
FIGS. 11 and 12 are front plan views of left and right shoulder straps of a second embodiment having pockets.
Figure 12:
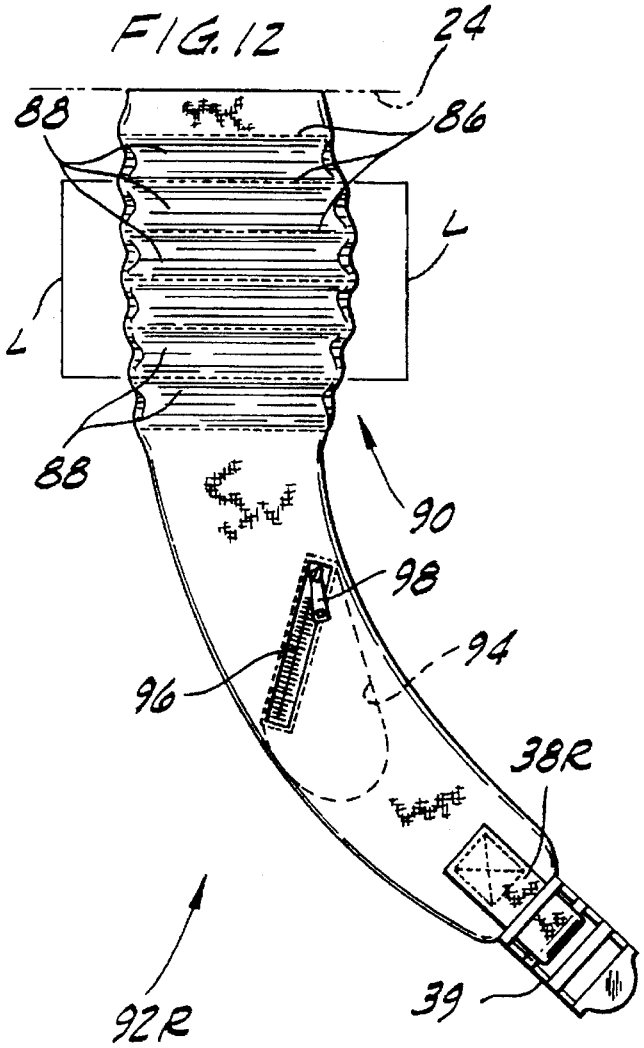

Referring now to FIGS. 11 and 12, a left shoulder strap 92L and a right shoulder strap 92R of a second embodiment of the present invention are shown. The parts of the shoulder straps 92L, 92R corresponding to those parts of shoulder straps 32L, 32R will be designated by the same reference numerals. The shoulder straps 92L, 92R each incorporate a pocket 94 (shown in hidden lines) having an opening extending generally longitudinally and transversely across the strap from generally adjacent to a laterally inner edge of the strap to generally adjacent to a laterally outer edge of the strap. The openings are closed by respective zipper closures 96 having slides 98. It is envisioned that a backpack (not shown) could incorporate both of the shoulder straps 92L, 92R or only one of them, the other shoulder strap being constructed like shoulder strap 32L or 32R.

The angulation of the openings (and zipper closures 96) permits a natural arm motion for zipping and unzipping the zipper closure. For example, to open the zipper closure 96 on the left shoulder strap 92L, the person P wearing the backpack would reach with his right hand across his torso and grasp the slide 98. Use of the right hand and arm is the most comfortable way to open the pocket when the backpack is being worn as shown in FIG. 2. Using a natural pivoting motion at the right elbow, the person P would then pull the slide 98 down and to the left to open the pocket. The pocket 94 may be closed by a similar, but reverse pivoting motion of the right arm. The pocket 94 on the right shoulder strap 92R may be opened and shut by similar motions of the left hand and arm.

The pockets 94 are sized for holding small items, such as car keys, which can be accessed quickly with a minimum of motion and without taking off the backpack. It is apparent that a right-handed person would tend to prefer a pocket on the left shoulder strap 92L which is most readily opened, shut and accessed with the right hand. The opposite would be true for a left-handed person.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An article comprising:

panels connected together and arranged for enclosing a volume, at least some of the panels being made of a generally limp material;

an opening in the article which is at least partially bounded by the generally limp panel material;

means for stiffening the generally limp panel material at least partially bounding the opening, said stiffening means biasing a region of the generally limp panel material at least partially bounding the opening to hold open the opening, said stiffening means comprising a resilient member connected to the bounding region of the generally limp panel material;

means associated with the generally limp panel material for holding said resilient member in a configuration displaced from a relaxed configuration of said resilient member.

2. An article as set forth in claim 1 wherein said resilient member is generally horseshoe shaped and has a pair of arms which are held inwardly from their relaxed positions by said holding means.

3. An article as set forth in claim 1 wherein said holding means comprises a pocket on the generally limp material at least partially bounding the opening, the pocket holding said resilient member therein and being shaped for constraining said resilient member in the displaced configuration.

4. An article as set forth in claim 1 wherein said holding means comprises stitching joining said resilient member to the generally limp panel material at least partially bounding the opening.

5. An article as set forth in claim 1 further comprising at least one shoulder strap being joined at opposite ends to the article, the strap comprising a load distributing region generally disposed for engagement with the top of the shoulder of a person wearing the article, said load distributing region of the strap being having a greater area engageable with the top of the shoulder than adjacent regions of the strap.

6. An article as set forth in claim 1 further comprising a pair of shoulder straps, each strap being joined at opposite ends to the article at spaced apart locations on the article for use in carrying the article on the back of a person.

7. Art article as set forth in claim 6 wherein each shoulder strap comprises a roll portion disposed for engaging the shoulders of a person wearing the article, the roll portion including a plurality of roll members extending generally transversely of the strap, each roll member being generally circular in cross section in a relaxed configuration, adjacent roll members defining generally transverse channels between them to permit passage of ventilating air between the shoulder strap and the shoulder of the person wearing the article, the channels having a depth selected to retain a spacing between the shoulder and the bottom of the ventilation channel when the article is worn by the person carrying a load in the backpack to permit said passage of ventilating air through the channel.

8. An article as set forth in claim 7 wherein each strap comprises a load distributing region generally disposed for engagement with the top of the shoulder of a person wearing the article, said load distributing region of the strap having a greater area engageable with the body of the person than regions of the strap immediately adjacent to the load distributing region and engageable with the body of the person immediately forward and rearward of the top of the shoulder.

9. An article as set forth in claim 7 further comprising frictionalizing material on each strap, the frictionalizing material being located for engagement with the shoulder of the person wearing the article.

10. An article as set forth in claim 9 wherein at least one strap further comprises a pocket and closure means for the pocket, the pocket having an opening extending generally longitudinally and transversely across the strap generally from a laterally inner edge of the strap toward a laterally outer edge of the strap.

11. An article as set forth in claim 1 wherein said resilient member has a greater rigidity in said displaced configuration than in its relaxed configuration to resist bending out of its plane thereby to stiffen the bounding region around the opening.

12. An article as set forth in claim 11 wherein said holding means holds the resilient member elastically deformed about an axis perpendicular to the plane of the resilient member in said displaced configuration.

13. An article as set forth in claim 11 wherein said resilient member is the sole component of the article which stiffens the limp material in the bounding region.

14. A backpack comprising:

panels including a front panel and a rear panel connected to the front panel, the front and rear panels being capable of at least partially defining a volume for holding items to be carried in the backpack;

a pair of shoulder straps, each strap having a front side and an underside, and being joined at opposite ends to the backpack at spaced apart locations on the backpack;

ventilation channels in the underside of at least a portion of the shoulder strap engageable with the top of the shoulder when the backpack is worn by a person, the ventilation channels extending generally transversely of the shoulder strap for passage of ventilating air between the shoulder and the strap; and a roll portion extending over a portion of each shoulder strap, said roll portion including a plurality of roll members extending generally transversely of the strap, each roll member being generally circular in cross section in a relaxed configuration, adjacent roll members defining generally transverse channels between them to permit passage of ventilating air between the shoulder strap and the shoulder of the person wearing the backpack, the channels having a depth selected to retain a spacing between the shoulder and the bottom of the ventilation channel when the backpack is worn by the person carrying a load in the backpack to permit said passage of ventilating air through the channel.

15. A backpack as set forth in claim 14 further comprising frictionalizing material on the underside of each strap, the frictionalizing material being located along the length of the strap for engagement with the top of the shoulder of the person wearing the backpack.

16. A backpack as set forth in claim 14 wherein at least one strap further comprises a pocket and closure means for the pocket.

17. A backpack as set forth in claim 16 wherein the pocket has an opening extending generally longitudinally and transversely across the strap generally from a laterally inner edge of the strap towards a laterally outer edge of the strap.

18. A backpack as set forth in claim 14 wherein each strap comprises a load distributing region generally located along the length of the strap for engagement with the top of the shoulder of the person wearing the backpack, said load distributing region of the strap having a greater area engageable with the body of the person wearing the backpack than portions of the strap immediately adjacent to the load distributing region and engageable with the body of the person wearing the article immediately forward and rearward of the top of the shoulder.

19. A backpack as set forth in claim 18 wherein said load distributing region comprises a projection extending laterally inwardly from a laterally inner edge margin of the shoulder strap such that the load distributing region is asymmetrical about any line extending lengthwise of the strap.

20. A backpack as set forth in claim 14 wherein at least some of the panels are made of a generally limp material and further comprising an opening in the article which is at least partially bounded by the generally limp panel material; means for stiffening the generally limp panel material at least partially bounding the opening, said stiffening means biasing a region of the generally limp panel material at least partially bounding the opening to hold open the opening, said stiffening means comprising a resilient member connected to the bounding region of the generally limp panel material; and means associated with the generally limp panel material for holding said resilient member in a configuration displaced from a relaxed configuration of said resilient member.

21. A backpack as set forth in claim 20 wherein said resilient member is generally horseshoe shaped and has a pair of arms which are held inwardly from their relaxed positions by said holding means.

22. A backpack as set forth in claim 20 wherein said holding means comprises a pocket on the generally limp material at least partially bounding the opening, the pocket holding said resilient member therein and being shaped for constraining said resilient member in the displaced configuration.

23. A backpack as set forth in claim 20 wherein said holding means comprises stitching joining said resilient member to the generally limp panel material at least partially bounding the opening.

24. A backpack comprising:

panels including a front panel and a rear panel connected to the front panel, the front and rear panels being capable of at least partially defining a volume for holding items to be carried in the backpack, at least some of the panels being made of a generally limp material;

an opening in the article which is at least partially bounded by the generally limp panel material;

means for stiffening the generally limp panel material at least partially bounding the opening, said stiffening means biasing a region of the generally limp panel material at least partially bounding the opening to hold open the opening, said stiffening means comprising a resilient member connected to the bounding region of the generally limp panel material;

means associated with the generally limp panel material for holding said resilient member in a configuration displaced from a relaxed configuration of said resilient member;

said resilient member being horseshoe shaped and having a pair of arms which are held inwardly from their relaxed positions by said holding means;

a pair of shoulder straps, each strap having a front side and an underside, and being joined at opposite ends to the backpack at spaced apart locations on the backpack; and ventilation channels in the underside of at least a portion of the shoulder strap engageable with the top of the shoulder when the backpack is worn by a person, the ventilation channels extending generally transversely of the shoulder strap for passage of ventilating air between the shoulder and the strap.

* * * * *